United States Patent [19]

Hanson

[11] Patent Number: 4,646,372

[45] Date of Patent: Mar. 3, 1987

[54] ARTICULATED HEAD BOARD ASSEMBLY

[76] Inventor: Paul B. Hanson, P.O. Box 291, Union City, Ga. 30291

[21] Appl. No.: 737,556

[22] Filed: May 24, 1985

[51] Int. Cl.[4] ..... A47C 22/00

[52] U.S. Cl. ..... 5/433; 5/53 B

[58] Field of Search ..... 5/53 B, 53 R, 53 D, 5/433

[56] References Cited

U.S. PATENT DOCUMENTS

| | | | |
|---|---|---|---|
| 2,724,127 | 11/1955 | Trivas et al. | 5/433 X |
| 3,683,430 | 8/1972 | Bradley | 5/433 X |
| 3,790,973 | 2/1974 | Bradley | 5/433 X |
| 4,015,298 | 4/1977 | Scott | 5/433 |

FOREIGN PATENT DOCUMENTS

| | | | |
|---|---|---|---|
| 2457664 | 1/1981 | France | 5/433 |
| 2094138 | 9/1982 | United Kingdom | 5/433 |

*Primary Examiner*—J. Karl Bell

*Attorney, Agent, or Firm*—Newton, Hopkins & Ormsby

[57] ABSTRACT

A headboard frame supports juxtaposed headrest assemblies recessed in a cavity of the frame and moveable upwardly out of the cavity. Constant tension spring mechanisms counterbalance each headrest assembly. Each headrest assembly includes a moveable standard slideable in the frame and a headrest pivotable carried on the standard. A latch locks the standard at prescribed heights.

50 Claims, 17 Drawing Figures

ARTICULATED HEAD BOARD ASSEMBLY

BACKGROUND OF THE INVENTION

1. Field of the Invention

This invention relates to a bed assembly and is more particularly concerned with an articulated headboard assembly in which the headboard carries moveable backrest assemblies.

2. Description of the Prior Art

In the past, numerous backrests have been devised for disposing cushions angularly with respect to the surface of the bed so that a person lying in the bed can rest his head or upper body thereon.

In the prior art, there is essentially no simple but effective way of counterbalancing the weight of the backrest assemblies so that they may be readily and easily adjusted using only a single hand. The present invention overcomes this disadvantage by providing a unique constant tension system and a latch structure which will permit the easy manipulation of the backrest without appreciable force.

SUMMARY OF THE INVENTION

Briefly described, the present invention includes a bed assembly having a horizontal mattress or bed frame supporting a conventional mattress, the front portion of the bed frame being provided with an upwardly opening U-shaped headboard frame. A pair of juxtaposed, backrest assemblies are carried by the headboard frame. Each backrest assembly includes vertically slideable, support standards, carried by the headboard frame and spring urged upwardly to counterbalance the weight of a support frame which is hinged at the top of each standard. Cams regulate the spring tension so that the weight of the support frame and its cushion is counterbalanced at any position along the travel of the standard. A manually operated cable of a latch mechanism provides for latching the backrest in an appropriate position.

Accordingly, it is an object of the present invention to provide a bed assembly having an articulated headboard assembly which is easy to manufacture, efficient in operation and durable in structure.

Another object of the present invention is to provide a bed assembly having an articulated headboard assembly in which the backrests can be disposed selectively in any one of a plurality of angular positions for receiving the head or upper body of a person lying on a bed.

Another object of the present invention is to provide a bed assembly having an articulated headboard assembly in which the backrest assembly stows at the head of a bed, concealed and in an unobstrusive manner.

Another object of the present invention is to provide a bed assembly having an articulated headboard assembly in which the backrests may be moved with a minimum of manual urging.

Other objects, features and advantages of the present invention will become apparant from the following description when taken in conjunction with the accompanying drawings wherein like characters of reference designate corresponding parts throughout the several views.

DESCRIPTION OF THE PREFERRED EMBODIMENTS

Figure 1:
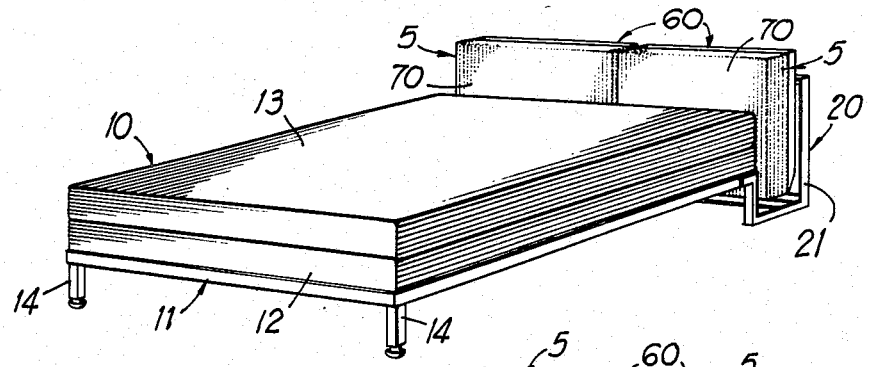
FIG. 1 is a perspective view of the bed assembly of the present invention, with the backrest assemblies lowered into the headboard frame.

Referring now in detail to the embodiment chosen for the purpose of illustrating the present invention, numeral 10 denotes generally a conventional bed which is provided with a horizontal bedframe 11, a box spring 12 supported by the frame 11 and a mattress 13 supported by the box spring 12. The frame 11 has feet 14 at the foot of the frame 11 and is provided with the headboard assembly of the present invention, this headboard assembly being denoted generally by the numeral 20.

Figure 4:
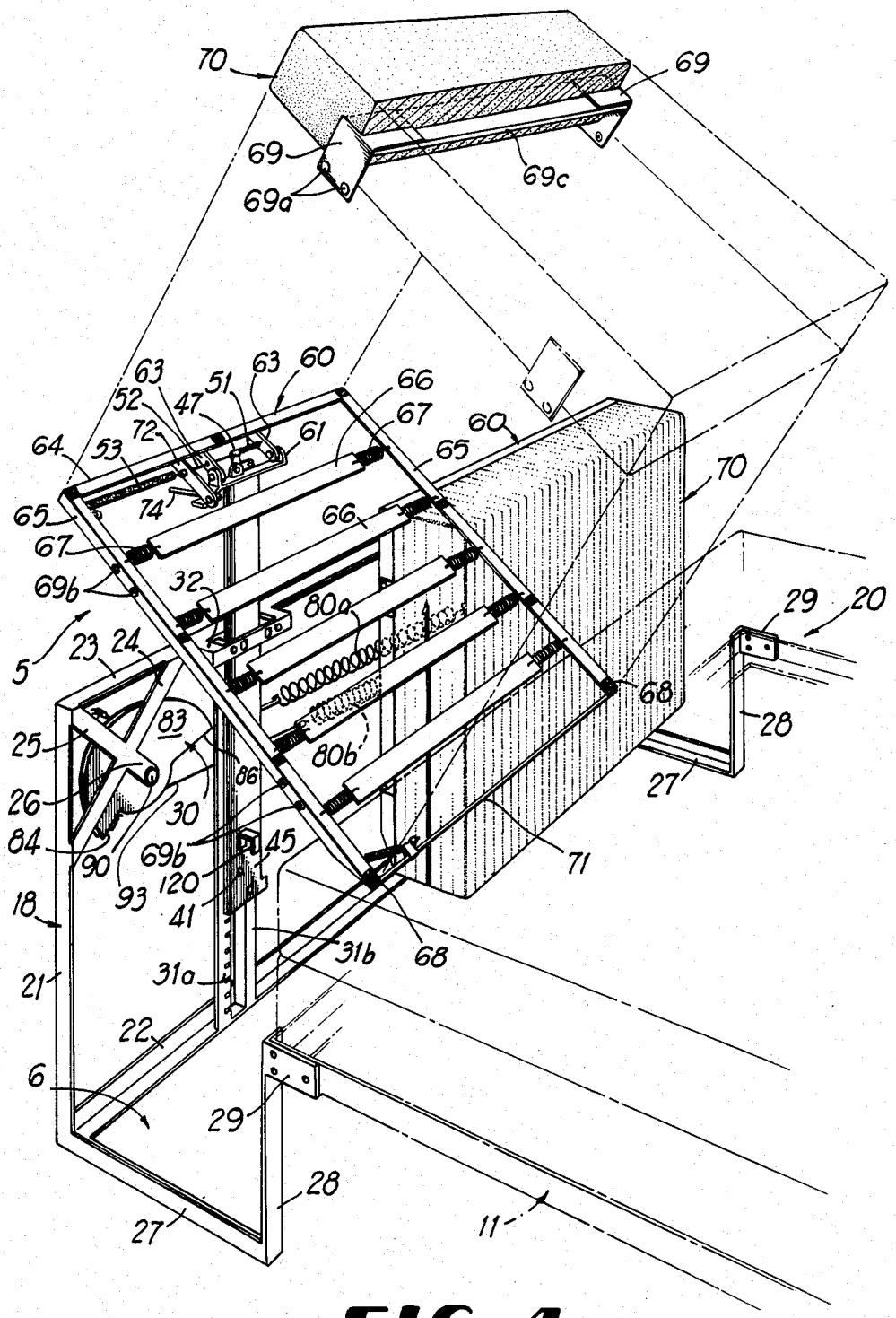
FIG. 4 is a fragmentary perspective view of a portion of the headboard assembly of the present invention.

In more detail, the headboard assembly 20 at one end of said bed 10, includes a vertically disposed, rectangular, upright, back frame 18, spaced from the end of the mattress 13. The frame 18 is formed of upstanding, spaced, parallel, side struts 21 joined at their lower ends by a transversely extending base cross strut 22 and at their upper ends by a transverse upper cross strut 23. The upper corners of this back frame are reinforced by spiders, each having a diagonal strap 24 extending between the intermediate portions of strut 21 and strut 23, as seen in FIG. 4. Inwardly and downwardly extending braces, such as brace 25, protrude from the upper corners of back frame 18 across the strap 24 and provide cam support fingers 26 inwardly from the strap 24.

At the bottom portion of the back frame 18, a pair of forwardly extending base bars 27 are connected by their ends to the lower corners of the back frame 18 and their free ends are provided with upstanding legs 28, the upper ends of which have L-shaped brackets 29 which receive the forward corners of the bed frame 11. The elements 21, 22, 23, 27 and 28 are all angle irons. The spider formed by the struts 24 and 25 extends across the edges of the flanges of the angle irons 21 and 23 so that the cam assemblies 30 supported by the fingers 26 will be within the confines of the back frame 18. The headboard assembly thus has a main frame formed by the back frame 18, the base bars 27 and the legs 28, which defines a transverse upwardly opening backrest receiving cavity 6 which receives the backrest assemblies 5. As shown in FIG. 1, backrest assemblies 5 are received in cavity 6 to an extent that cushions 70 are exposed above the mattres only sufficiently to allow a pillow to be laid against the cushion 70 and the bedspread to be placed over the cushion 70 when the bed is made so as to hide cushions 70 from view.

Carried by the back frame 18, namely, by the cross struts 22 and 23, are upstanding guide member **31*b* and latch receiving member 31*a*. The upper ends of these standards 31*a* and 31*b* terminate at a guide housing 32 which is mounted to the upper strut 23. A downwardly extending case 34 is secured to the back side of housing 32. This case 34 is open on one side and at the bottom and supports a pin 35, on which is journalled for rotation, a pulley or sheath 36**.

The space 37 between each opposed pair of standards **31*a* and 31*b* is defined by opposed flanges of the angle irons which form the two standards or uprights 31*a* and 31*b*. Along the common edge of the flange of latch receiving member 31*a* are provided a plurality of finger receiving slots 38, into any one of which latch finger 39 of a bellcrank 40 of a detent means is received. The bellcranks 40 are pivotally secured by pivot pins 41 to the backsides of a pair of opposed parallel, flat, rectangular upstanding, vertically moveable, support standards 45 of a pair of headrest assemblies 5. The function of the fingers 39 are to lock the standards 45** in their vertically adjusted positions along their paths of travel.

A single support standard 45 is employed to support each backrest assembly 5, thus eliminating the problem of binding that has been encountered with previously used backrest assemblies that employ two standards for each backrest assembly.

The bellcranks 40 are respectively connected to the lower ends of actuator rods 46 which respectively extend upwardly to connect to the outer ends of bellcranks 47. Bellcranks 47 are pivotally carried by pivot pins 48 on upstanding brackets 49, respectively mounted on flat mounting plates 50 on the upper ends of the standards 45. The bellcranks 47 are spring urged by tension springs 51 to positions which permit the fingers 39 to latch into any one of its associated slots 38, depending upon the vertical positioning of the standards 45.

Aligned with the springs 51 and connected to the bellcranks 47 are release control cables 52 which pass around a portion of the inside perimeter of a U-shaped support frame, denoted generally by the numeral 60. The control cables 52 are provided with a flexible resilient tubular handle 53 and a rigid tubular handle 54 by means of which the cables 52 can be pulled out of their normal positions for respectively manipulating the bellcranks 47 so as to withdraw the fingers 39 from their slots 38. When the fingers 39 are so removed, the upright standards 45 can be raised and lowered, as desired.

Extending up from the ends of the mounting plates 50 are pairs of brackets 61 which carry pivot pins 62. The pivot pins 62, in turn, carry pairs of upstanding brackets 63, the upper ends of which are fixed to a cross bar 64 of the U-shaped headrest frame 60. This frame 60 includes the cross bar 64 and a pair of downwardly extending, opposed, spaced, parallel arms 65, protruding from the ends of the cross bar 64 and between which are disposed the spaced parallel flexible back straps 66. Opposed pairs of springs 67, which extend inwardly from the arms 65, yieldably support each of the straps 66. Attachment means 68 at the front corners of each of the U-shaped headrest frames 60 removably carry a pillow or cushion 70, thereon. Cushions 70 are also removably held in place by moderately wide hinged straps 69 constructed of moderately rigid plastic strips which are attached to rigid members **69*c* which are constructed of thin plywood, plastic or other suitable material. Rigid members 69*c* are embeded in the core of cushions 70 as shown in FIG. 4. Alternatively, rigid members 69*c* are cemented to the bottom of said cushions 70. Each hinging strap 69 having snap fasteners 69*a* which engagably cooperate with snap fasteners 69*b* on arms 65, to removably secure cushion 70 in place. The lower end portion of each of the U-shaped headrest frames 60 includes a thin bar or rod 71 in the plane of the straps 66**.

Figure 5:
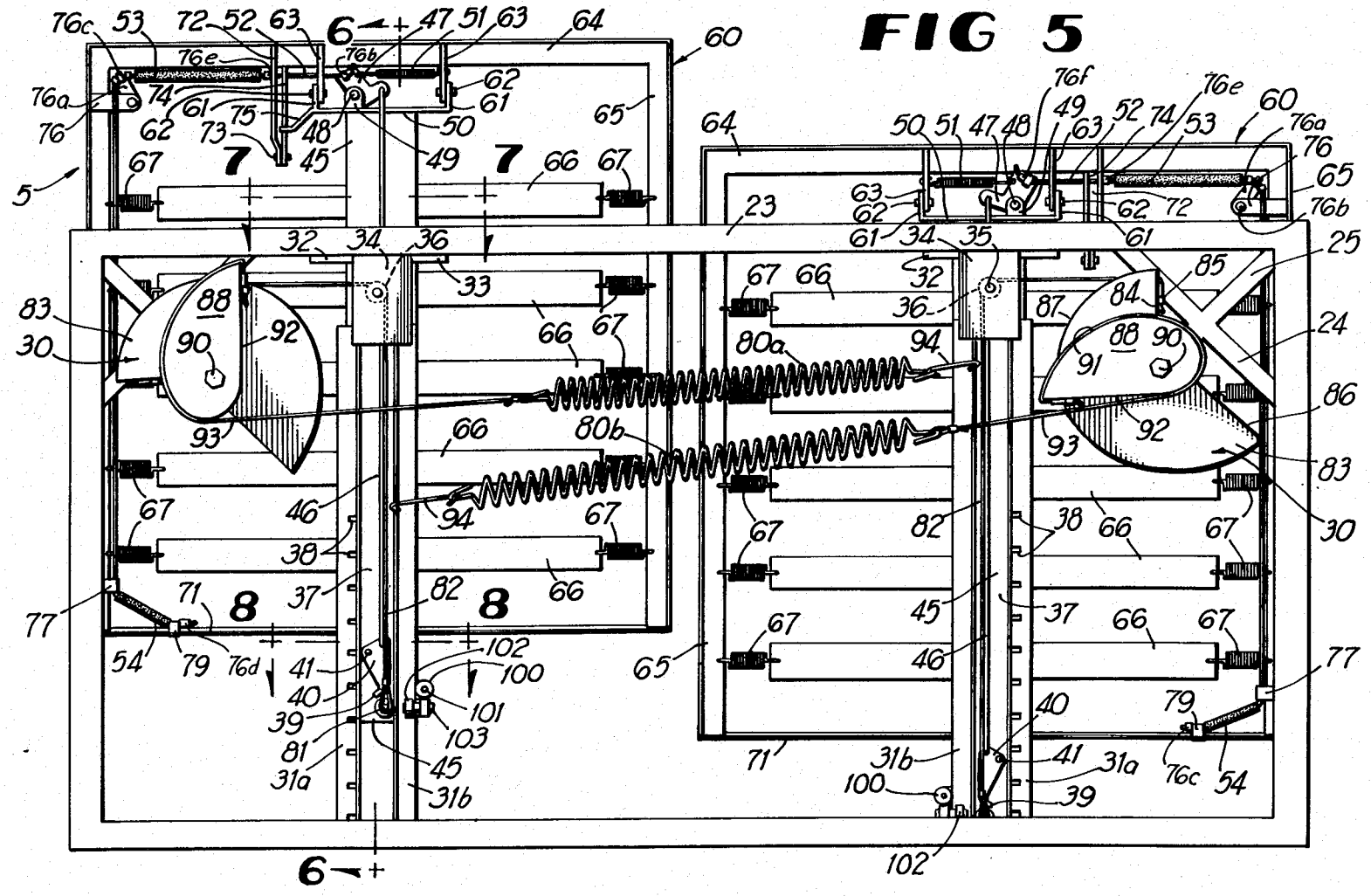
FIG. 5 is a rear elevational view of the headboard assembly depicted in FIG. 4, the backrest assemblies thereof being in different vertically adjusted positions.
Figure 7:
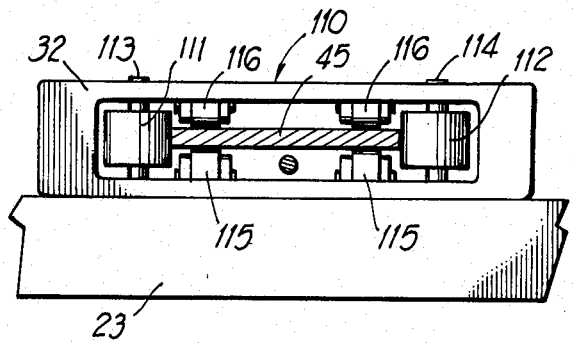
FIG. 7 is a cross-sectional view taken substantially along line 7—7 in FIG. 5.
Figure 8:
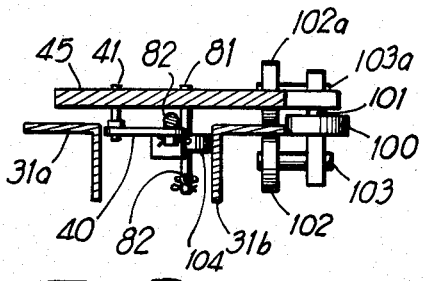
FIG. 8 is a cross-sectional view taken substantially along line 8—8 in FIG. 5.
Figure 6:
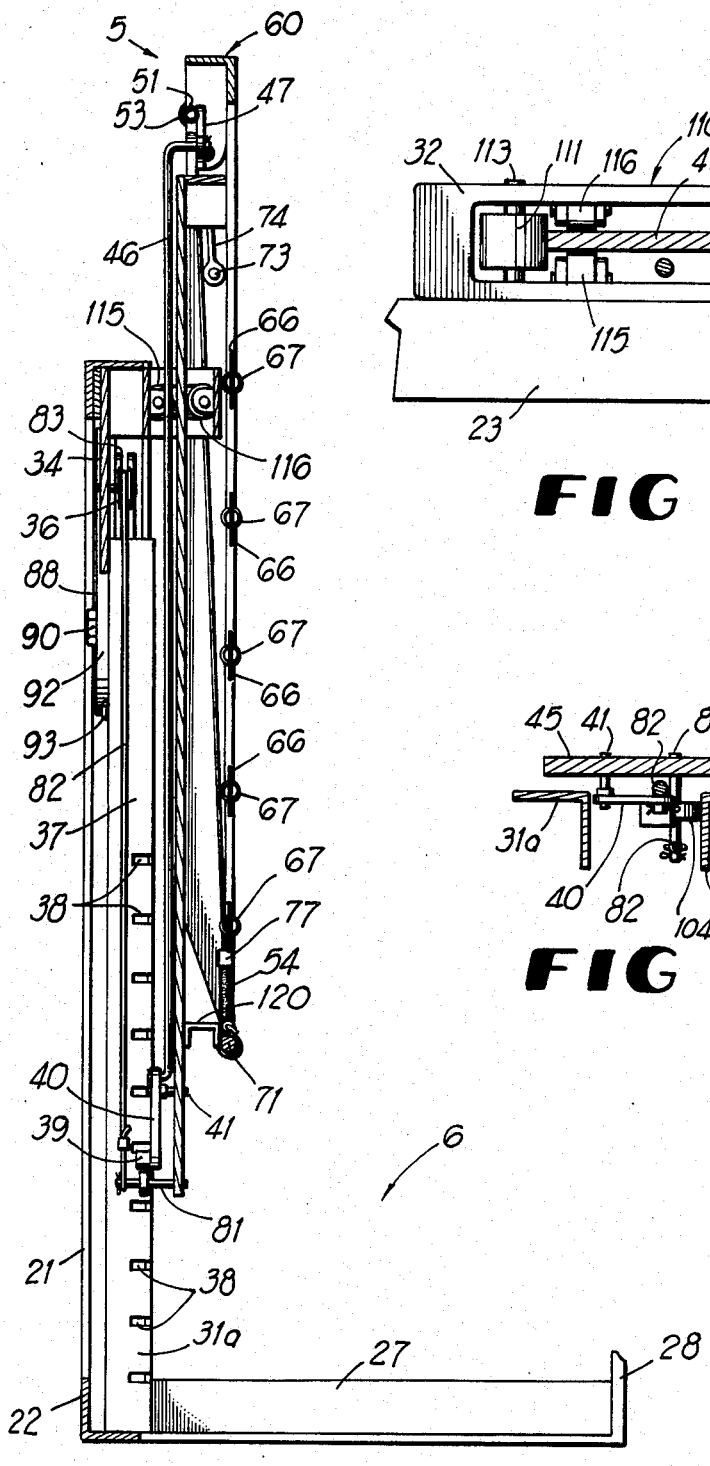
FIG. 6 is a vertical sectional view taken substantially along line 6—6 in FIG. 5.

Extending downwardly from each cross bar 64 is an arm 72, seen in FIGS. 4 and 5. These arms 72 support, at their lower ends, pivot pins 73 which respectively pivotally carry upstanding pivot fingers 74 which ride against the cables 52, respectively. A fixed cam arm 75 extends sidewise and downwardly from the corner of each mounting plate 50 so that, when the frame 60 pivots to its vertical position, as shown in FIG. 6, the pivot finger 74 is arrested in its movement with the frame 60 and is, therefore, urged forwardly by the stationary arm 75 for thereby urging a portion of the cable 52 in a forwardly direction.

It will be remembered that the cable 52 extends around a portion of the inside perimeter of the backrest frame 60. This cable 52 is immovably retained by arm **76*a* which pivots on pin 76*b* mounted on bracket 76 and slideably retained by bracket 77 and is fixed or anchored to the thin rod 71 at its end, at numeral 79. Furthermore, the cable 52 slideably extends through holes which are aligned with each other in the bracket 63 and arm 72 which are spaced on opposite sides of the pivotable finger 74. Thus, the deforming of that portion of the cable 52 between the bracket 63 and arm 72 will cause the bellcrank 40 to be pivoted to its pivoted position, as shown in FIG. 5. This, in turn, assures that the finger 39 of bellcrank 40 is held in a removed position, as shown in FIG. 5. Thus, so long as the frame 60 remains vertical, finger 39 will be retracted so as to permit vertical movement of the frame 60 and its supporting standard 45. As shown in FIG. 5, fixed to cable 52 between arm 72 and handle 53 is ferrel 76*e*. Ferrell 76*e* thus prevents cable 52 from being pulled towards bellcrank 47 when finger 74 deforms cable 52, and so allows bellcrank 47** to be pivoted.

For counterbalancing the weight of the moveable portion of each backrest assembly 5, i.e., to provide constant tension, there are spring and cam assemblies for each of these backrest assemblies. The spring and cam assembly for the right hand backrest assembly 5 is substantially the same as the spring and cam constant tension assembly for the left hand backrest assembly 5, except that the spring 80*a* for the left hand assembly 5 is disposed above the spring 80*b* for the right hand assembly 5. Thus, the vertically moveable standards 45 of the respective assemblies 5 have, at their lower portions, cable receiving pins 81, around which is looped the lower ends of cables 82. These cables 82 extend upwardly in the spaces 37, passing over the pulleys 36 and, thence, outwardly, their outer end portions being received in the grooves of the cable cams 83 of the cam assemblies 30. Each cable cam 83 has a generally rounded periphery 87 extending through approximately 225° and also has a radially extending end surface 84 to which the end portion of the cable 82 is fixed by means of clamps 85. As best seen in FIG. 4, the back surface 84 is shorter than the back surface 86 which is at the other end of the cable cam 83 and the diameter of the cable cam 83 progressively increases over the 225° arc from surface 84 to surface 86. This entire cam periphery or surface 87 is grooved so as to retain therein the cable 82 as the cable cam 83 rotates. The outer surface of each cable cam 83 is fixed to the inner surface of a spring cam 88. The spring cam 88 and the cable cam 83 of each spring and cam assembly 30 is mounted on its pivot pin 90 carried by arm 26.

Each spring cam 88 defines a variable radius, i.e., involute surface 91 over approximately 270° and a flat surface 92 over the remainder of the periphery of the cam. A cable 93 wrapped around each of the cams 88 along the involute surface 91, is connected to its spring 80*a* or 80*b*, as the case may be.

The springs 80*a* and 80*b* extend generally laterally across the back frame 18, being respectively attached by their far ends to hook members 94 which engage the guide member 31*b* of the adjacent backrest assembly 5, as illustrated in FIG. 5. By such an arrangement, the spring 80*a* or 80*b*, as the case may be, applies through its cam assembly 30 a constant tension on its associated cable 82, so that, regardless of the height at which the backrest assembly 5 is positioned, the force applied by the cable 82 on its individual assembly 5 is just sufficient for the backrest assembly 5 to remain at the selected height. Thus, only minimal pressure is required to either raise or lower a backrest assembly 5.

When the frame 60 of an assembly 5 is tilted outwardly, pivoting about the pivot pins 62, the finger 74, associated therewith, is automatically moved to a position where the bellcrank 40 is released, thereby permitting the detent finger 39 to be engaged in a slot 38, and thereby latching the assembly 5 at the appropriate height. By depressing or pulling on the flexible handle 53 or rigid handle 54, the height of the angled frame 60 and cushion 70 can be adjusted vertically without necessarily changing the angular position thereof. When the handle 53 or 54 is released, the pin 39 will be released to engage in an aligned slot 38, and thus lock the assembly 5 at a prescribed height. Where the assembly 5 is in a vertical position, as shown in FIG. 6, the thin steel bar 71 rests against a magnetic stop 120 on standard 45. When the assembly 5 is raised, and the frame 60 extends over mattress 13, its outer edge rests on and slightly imbeds in the upper surface of mattress 13.

Referring to the cam assemblies 30, it will be seen that the cam assembly 30 will rotate to take in one cable 93 or 82 while progressively releasing increments of the other cable 82 or 93 and vice versa. When the spring 80*a* or 80*b*, as the case may be, is in its most relaxed position, the spring cam 88 will be disposed so that the cable 93 is at a maximum distance from the pivot pin 90 and, conversely, when the spring 80*a* or 80*b* has extended its maximum distance, the cable 93 will be at its closest position to the pin 90 along the progressively varying involute surface 91. This assures a reasonably constant or uniform spring tension applied to the cable 82, regardless of the amount of elongation of the spring 80*a* or 80*b* (within its elastic limits).

For guiding the upright standard 45 in its vertical movement, each standard 45, at its lowermost portion, is provided with a side guide roller 100 which rides along an edge of the upright 31*b*, rotating about a pivot pin 101 secured to the lower end portion of the standard 45 and also opposed, spaced side guide roller 104 which rides along the opposite edge of upright 31*b*, rotating about a pivot pin 81 which is also secured to the lower end portion of the standard 45. Pivot pin 81 projects beyond roller 104 to allow for attaching standard lifting cable 82. Furthermore, the standard 45 is provided with a front roller 102*a* and back roller 102 which ride along the front and rear surfaces of the flange of the upright 31*b*, the roller 102 rotating about a pivot pin 103 and the roller 102*a* rotating about a pivot pin 103*a* carried by the lower end portion of the standard 45.

Each guide housing 32 has a pair of transversely opposed guide rollers 111 and 112 which respectively rotate about pins 113 and 114 on the housing 32. The rollers 111 and 112 have inner peripheries which are spaced apart by a distance approximately equal to the width of the associated standard 45 and, therefore, these rollers 111 and 112 form upper guides for the standard 45. In addition, spaced front rollers 115 on housing 32 are provided for guiding the front surface of the upright standard 45 while spaced rear rollers 116 on housing 32 engage the rear surface of the upright 45 and provide a guide therefor. These rollers 115 and 116 rotate about transverse axes and the rollers 111 and 112 rotate about longitudinal axes, with respect to the length of the bed 10.

Figure 2:
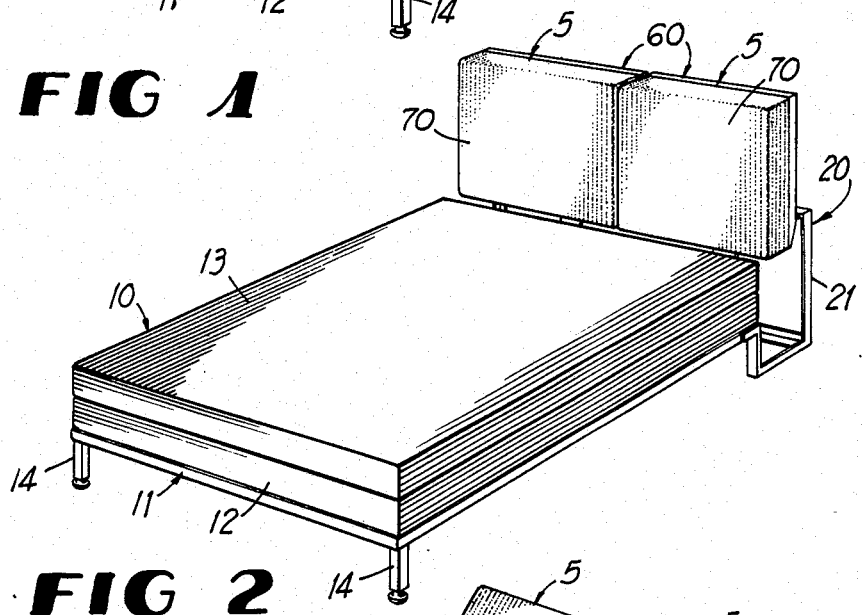
FIG. 2 is a view similar to FIG. 1, but showing the two backrest assemblies in their raised positions.
Figure 3:
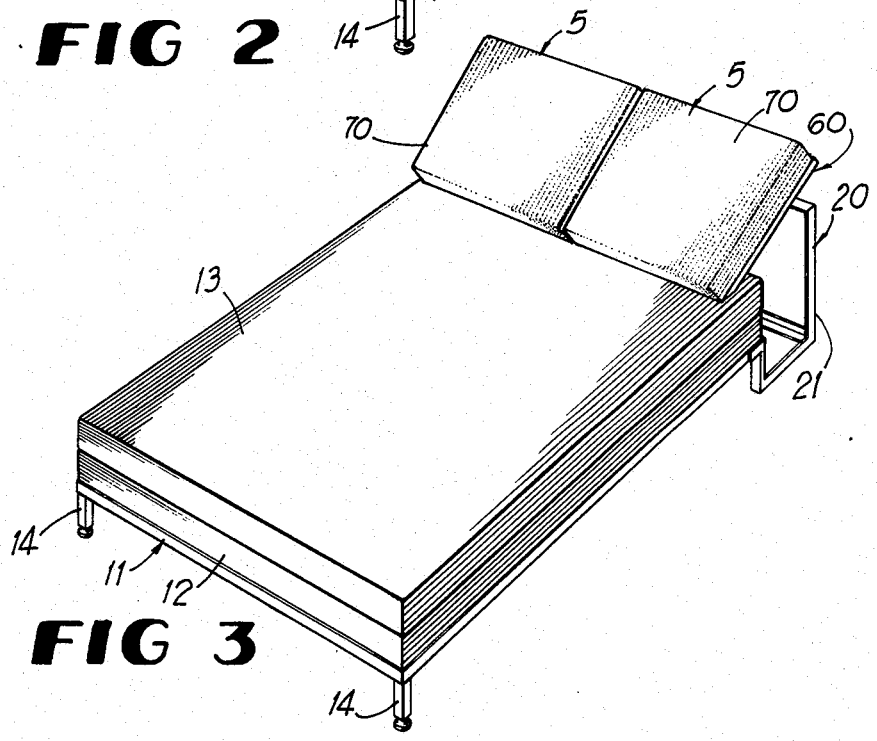
FIG. 3 is a view similar to FIGS. 1 and 2, but showing the backrests of the backrest assemblies tilted for disposing them at angles to the bed.

From the foregoing description, the operation of the device is apparent. The backrest assemblies 5 are normally retained in the transverse recess in the frame of headboard assembly 20. Each of these backrest assemblies 5 can be raised or lowered individually as illustrated in FIG. 2. Furthermore, when either of the assemblies 5 is raised, it can then be tilted to extend over mattress 13 at substantially any angular position, as illustrated in FIG. 3. Each assembly 5 can then be raised or lowered, while in its tilted position over mattress 13, by the depression of the handle 53 or 54, as explained above. The thin rods 71 imbed in the top of mattress so as to cause no discomfort to the back of a person resting on assembly 5. The rods 71 add enough surface to the end portions of arms 65 so as not to damage the bedding when they bear on the mattress.

It will be obvious to those skilled in the art that many variations may be made in the embodiment here chosen for the purpose of illustrating the present invention without departing from the scope thereof as defined by the appended claims.

Figure 9:
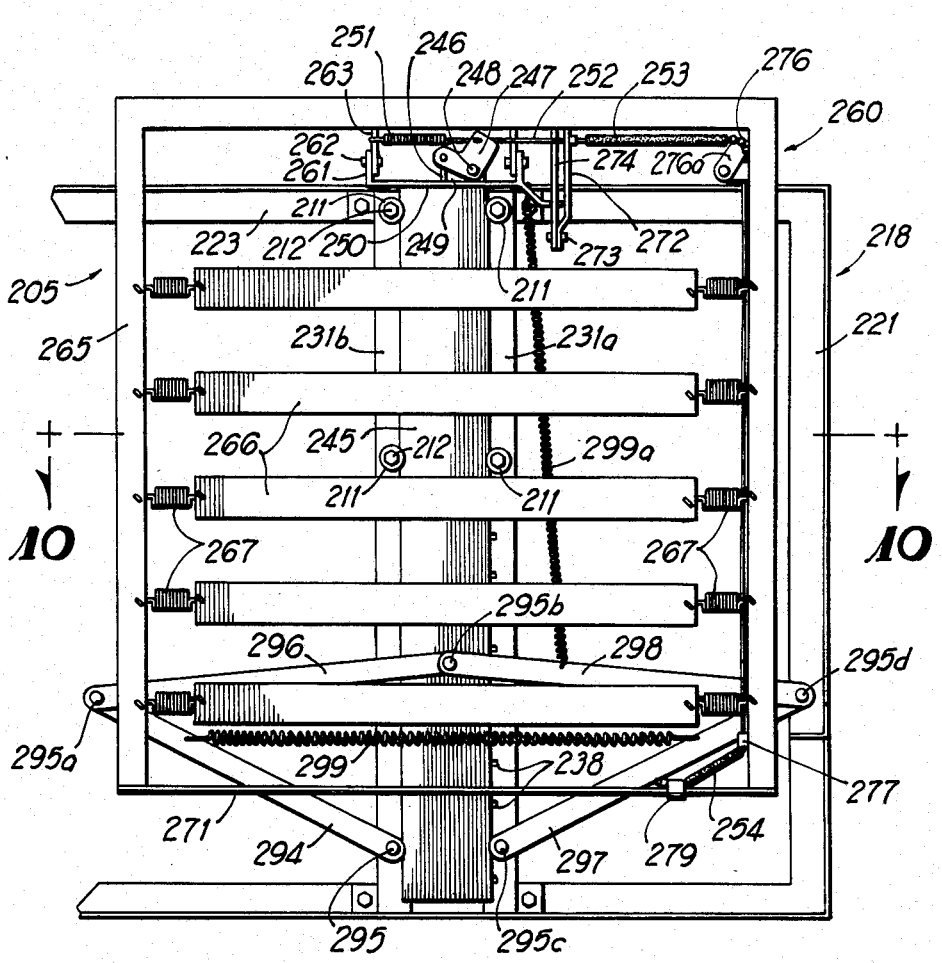
FIG. 9 is a front view of a second embodiment of the headboard assembly in its lowered position.
Figure 10:
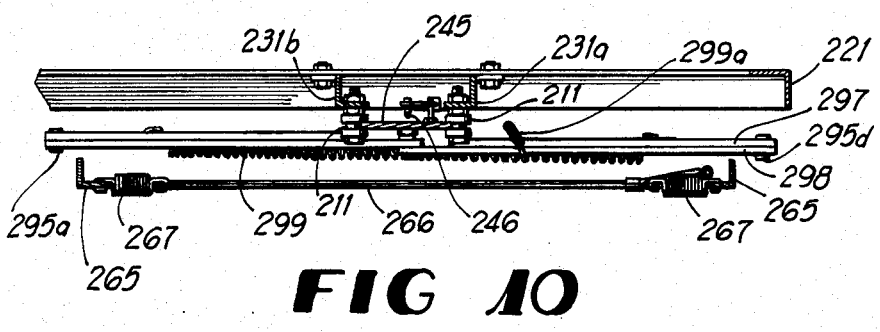
FIG. 10 is a horizontal sectional view taken substantially along lines 10—10 in FIG. 9.
Figure 11:
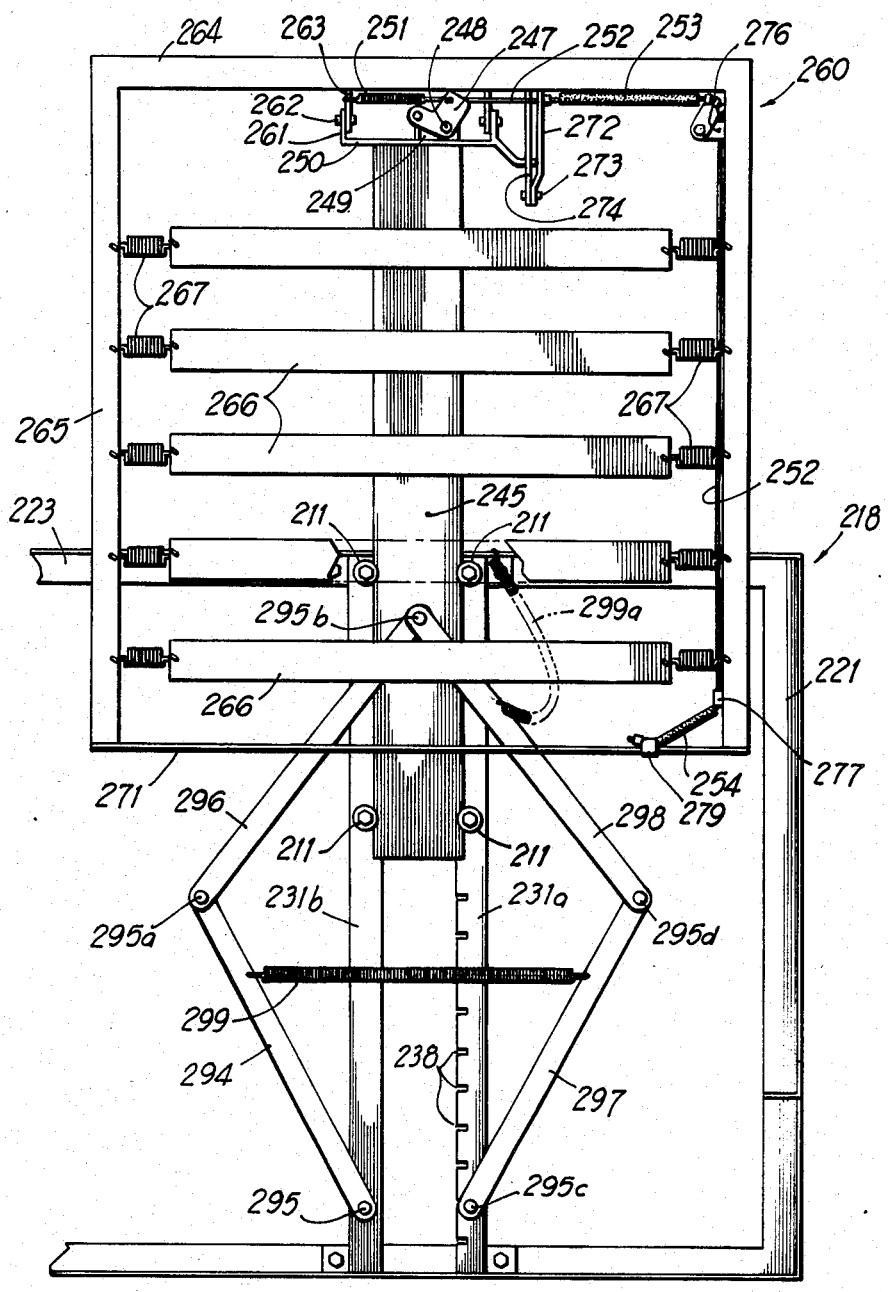
FIG. 11 is a front view of the headboard assembly depicted in FIG. 9 in its raised position.
Figure 12:
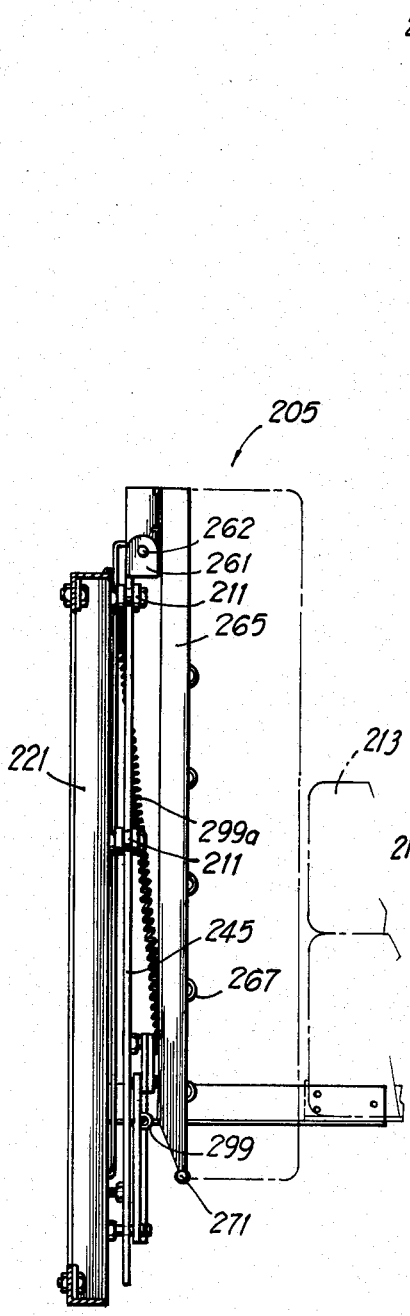
FIG. 12 is a vertical sectional view of the headboard assembly depicted in FIG. 9 in its lowered position.
Figure 13:
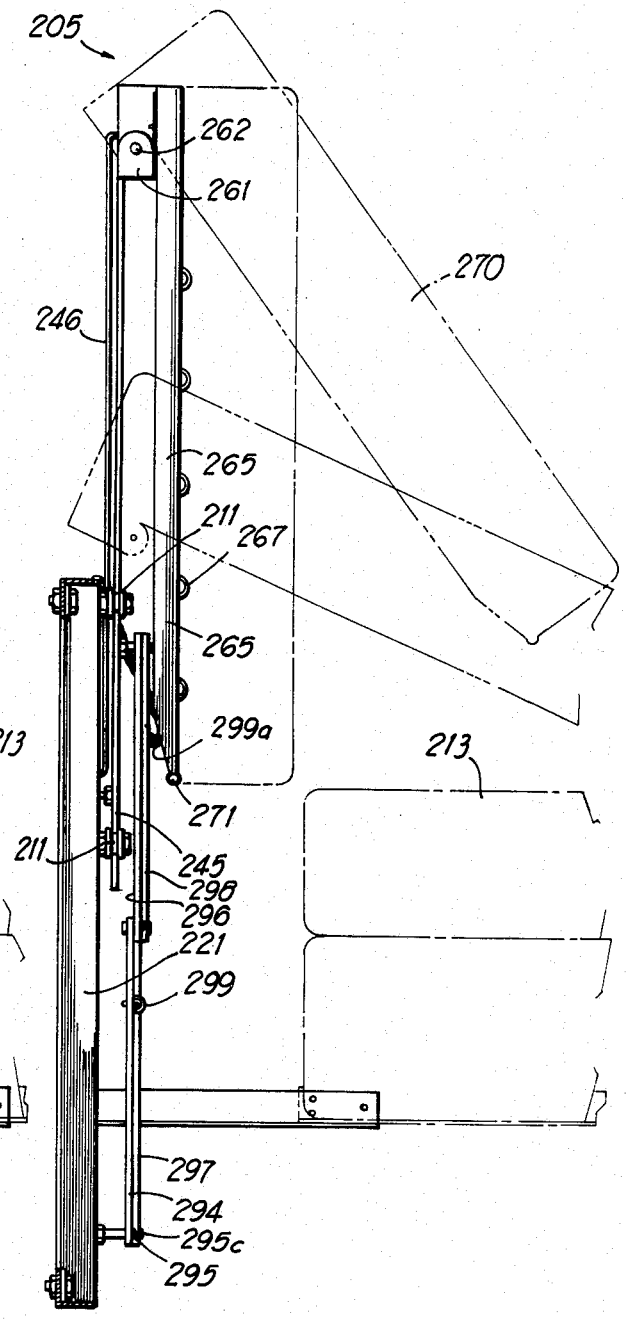
FIG. 13 is a vertical sectional view of the headboard assembly depicted in FIG. 9 in its raised position.

A second embodiment, initially illustrated in FIG. 9, is comprised of various elements which are identical to those in the first embodiment, including: back frame 218, side struts 221, cross struts 222 and 223, guide members 231*b*, latch receiving members 231*a* with finger receiving slots 238, latch fingers 239 (not shown), bellcranks 240, pivot pins 241, support standards 245, actuator rods 246, bellcranks 247, pivot pins 248, brackets 249, mounting plates 250, tension springs 251, control cables 252, backrest frames 260, handles 253 and 254, brackets 261 and 263, pivot pins 262, cross bars 264, arms 265, straps 266, springs 267, attachment means 268, hinged straps 269, fasteners 269*a* and 269*b*, cushions 270, rods 271, arms 272, pivot pins 273, pivot fingers 274, cam arms 275, brackets 276 and 277, arms 276*a*, pins 276*b*, and ferrels 276*e*. These elements function in the same manner as enumerated above in the detailed description of the first embodiment. Instead of the spring and cam assembly of the first embodiment, however, the second embodiment utilizes a spring and scissors assembly to counterbalance the weight of the moveable portion of each backrest assembly 205. Each spring and scissors assembly provides substantially constant tension. The spring and scissors assembly for the right hand backrest assembly 205 is substantially the same as the spring and scissors assembly for the left hand backrest assembly 205. Each spring and scissors assembly is comprised of a plurality of pivoted arms and springs or tension means. Thus, an arm 294 is pivotally attached to the lower portion of guide member 231*b* by pin 295. Arm 296 is pivotally attached to the outer end of arm 294 by pin 295*a*. Arm 296 is further pivotally attached at its inner end to the lower midportion of slidable standard 245 by pin 295*b*. Similarly, arm 297 is pivotally attached to the lower portion of latch receiving member 231*a* by pin 295*c*. Arm 298 is pivotally attached to the outer end of arm 297 by pin 295*d*. Arm 298 is also pivotally attached to slidable standard 245, with arm 296, by pin 295*b*, so that both arms 296 and 298 pivot on support standard 245 by pin 295*b*. This arrangement is such that when the support frame 260 is in its lowered position, as shown in FIG. 9, acute angles are formed between arms 294 and 296, and between arms 297 and 298, respectively, and an oblique angle is formed between arms 296 and 298. A spring or tension means 299 is attached to the outer midportions of arms 294 and 297, as shown in FIGS. 9 and 11, so that the spring is stretched to a maximum extent within its elastic limits when the support frame 260 is in its lowered position. The spring 299 thus tends to contract and urge arms 294 and 297 into a more upright position which in turn moves arms 296 and 298 to push support standard 245 into a raised position. Support standard 245 is slidably received between grooved rollers 211 which are journaled on pins 212 which are secured to guide member 231*b* and latch receiving member 231*a* respectively, to permit upward and downward vertical movement thereof. A second spring or tension means 299*a* is attached to cross strut 223 adjacent to latch receiving member 231*a* at one end, and to the inner midportion of arm 298 at its other end, as shown in FIG. 11. Spring 299*a* can alternately be attached to cross strut 223 adjacent guide member 231*b* at one end and to the inner midportion of arm 296 at its other end. This spring 299*a* is also stretched to a maximum extent within its elastic limits when the backrest frame 260 is in its lowered position, and provides enough tension to aid in initial movement of the scissors arms and so aids in urging the backrest frame 260 into a raised position, as is depicted in FIG. 11. FIG. 12, illustrates a side view of the second embodiment of assembly 205 in its lowered position. FIG. 13 illustrates a side view of the same backrest assembly 205 in a raised position and also depicts cushion 270 in phantom lines, angularly disposed in relation to the mattress 213. The operation of the second embodiment of the device is identical to the operation of the first embodiment as previously described. Only the means of providing constant tension to backrest assemblies 205 and of slidably receiving slidable standards 245 has been modified.

Figure 14:
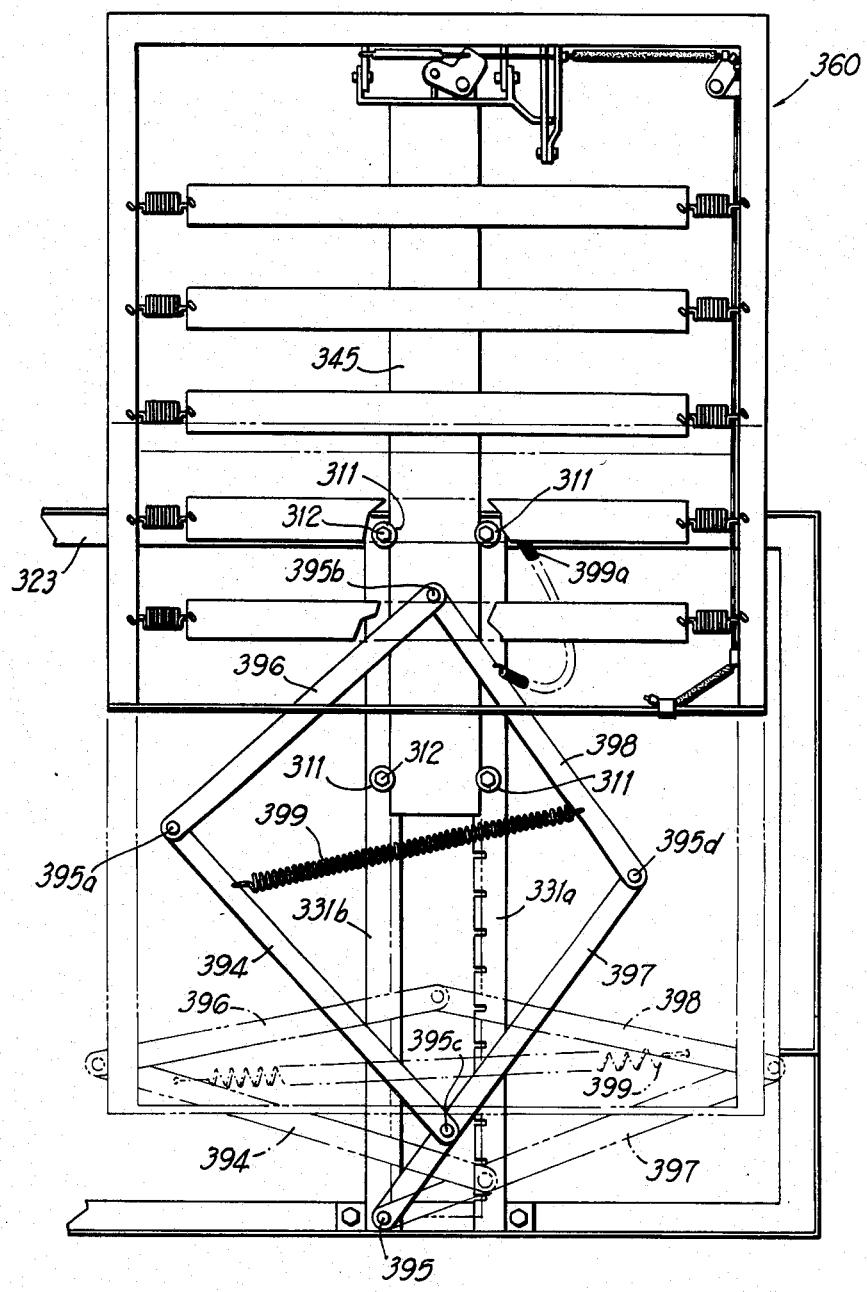
FIG. 14 is a front view of a third embodiment of the headboard assembly in its raised position.

A variation of the spring and scissors assembly of the second embodiment is depicted in FIG. 14 as a third embodiment and is comprised of a principal arm 397 pivotally attached by pin 395 to the lower portion of guide member 331*b* and extending upwardly and interiorly to guide member 331*b* and latch receiving member 331*a* and across latch receiving member 331*a* as shown in FIG. 14. Pivotally attached to the outer end of arm 397 by pin 395*d* is arm 398. The inner end of arm 398 is attached to the lower midportion of support standard 345 by pin 395*b*. Arm 394 is pivotally attached to the lower midportion of arm 397 by pin 395*c* and upwardly extends interior to and across guide member 331*b*. Arm 396 is pivotally attached at one end to the outer end of arm 394 by pin 395*a* and is also attached by its other end to the lower midportion of support standard 345 with arm 398 by pin 395*b*. Support standard 345 is slidably received between grooved rollers 311 to permit upward and downward vertical movement thereof. Grooved rollers 311 are mounted by pins 312 to guide member 331*b* and latch receiving member 331*a* as shown in FIG. 14. This arrangement is such that when the backrest frame 360 is in its lowered position, acute angles are formed between arms 394 and 396, and between arms 397 and 398 respectively, and oblique angles are formed between arms 396 and 398 and between arms 394 and 397 respectively, as shown by phantom lines in FIG. 14. A spring 399 is attached at one end to the outer midportion of arm 394 and also attached at its other end to the outer midportion of arm 398 so that when the backrest frame 360 is in its lowered position the spring is stretched within its elastic limits. Thus, the spring 399 urges arms 394 and 398 into a more upright position which in turn move arms 396 and 397 into a more upright position, and thus enable arms 396 and 398 to push support standard 345 into a raised position.

A second spring 399*a* is attached to cross strut 323 adjacent to latch receiving member 331*a* at one end, and to the inner midportion of arm 398 at its other end. Spring 399*a* can alternately be attached to cross strut 323 adjacent to guide member 331*b* at one end and to the inner midportion of arm 396 at its other end. Thus spring 399*a* is also stretched to a maximum extent within its elastic limits when the backrest frame 360 is in its lowered position. This second spring 399*a* provides enough tension to aid in initial movement of the scissors arms when support standard 345 is in its lowermost position and so aids in urging the backrest frame 360 into a raised position.

Figure 15:
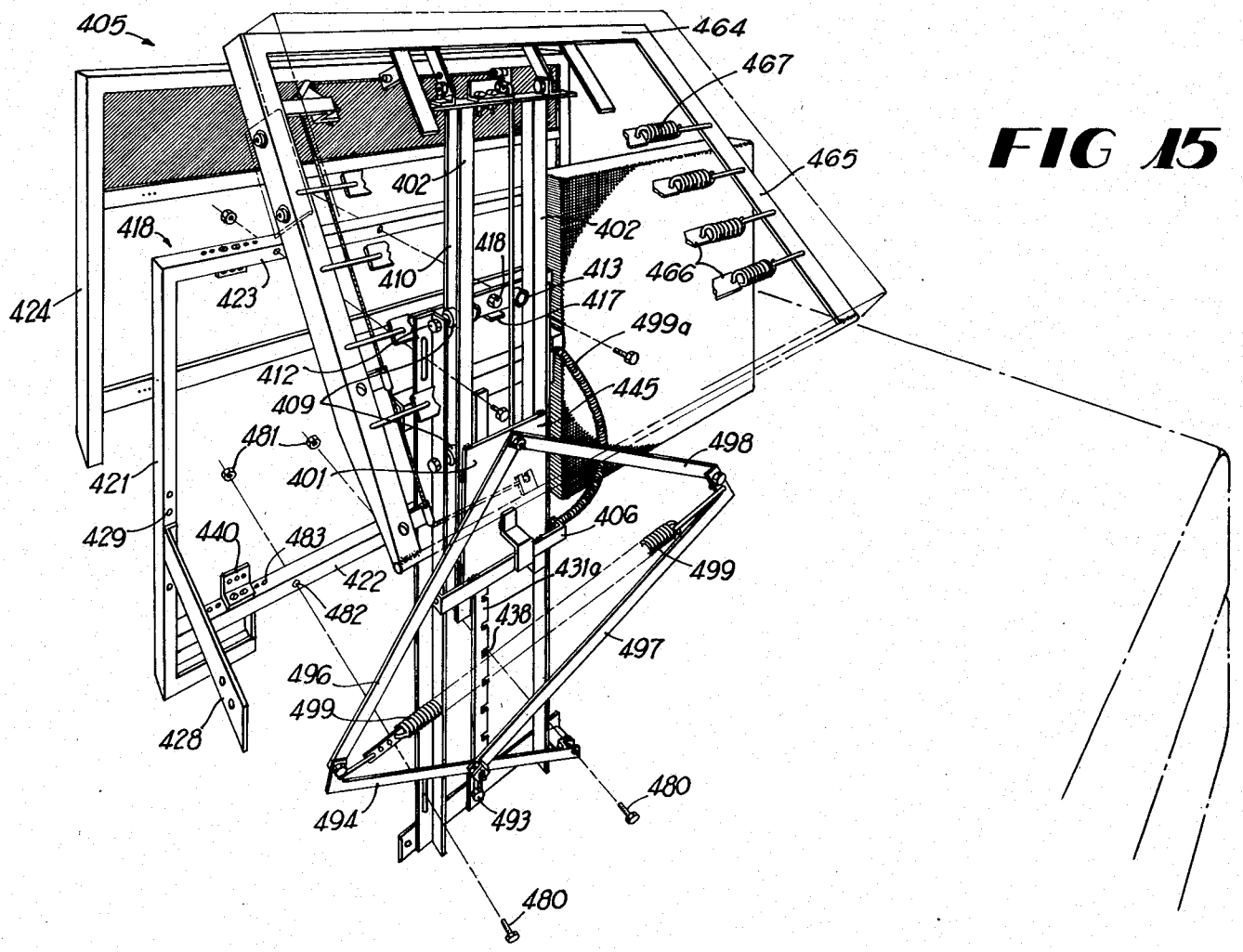
FIG. 15 is a perspective view of a fourth embodiment of the head board assembly.
Figure 16:
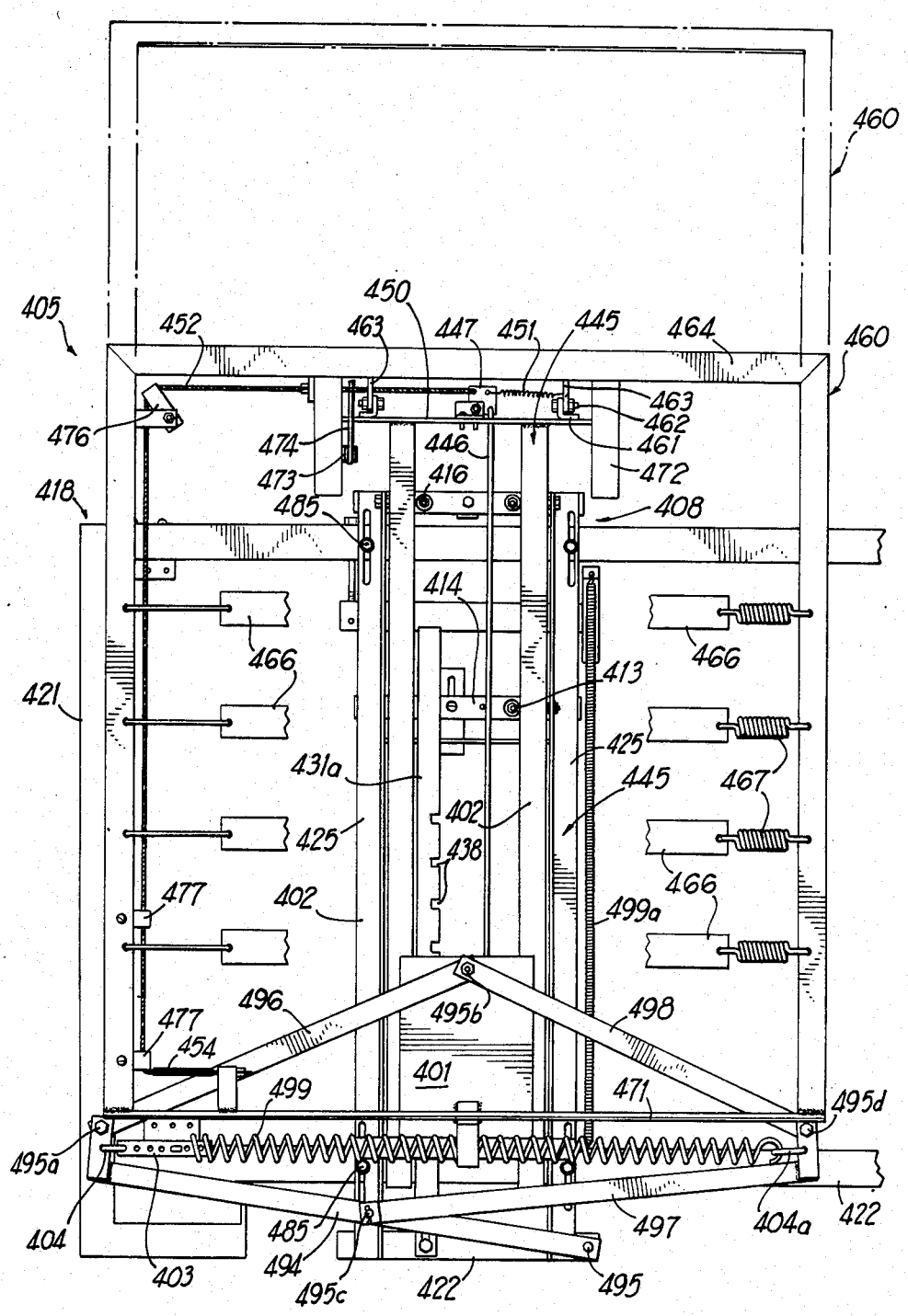
FIG. 16 is a front elevational view of a fourth embodiment of the head board assembly in its lowered position.
Figure 17:
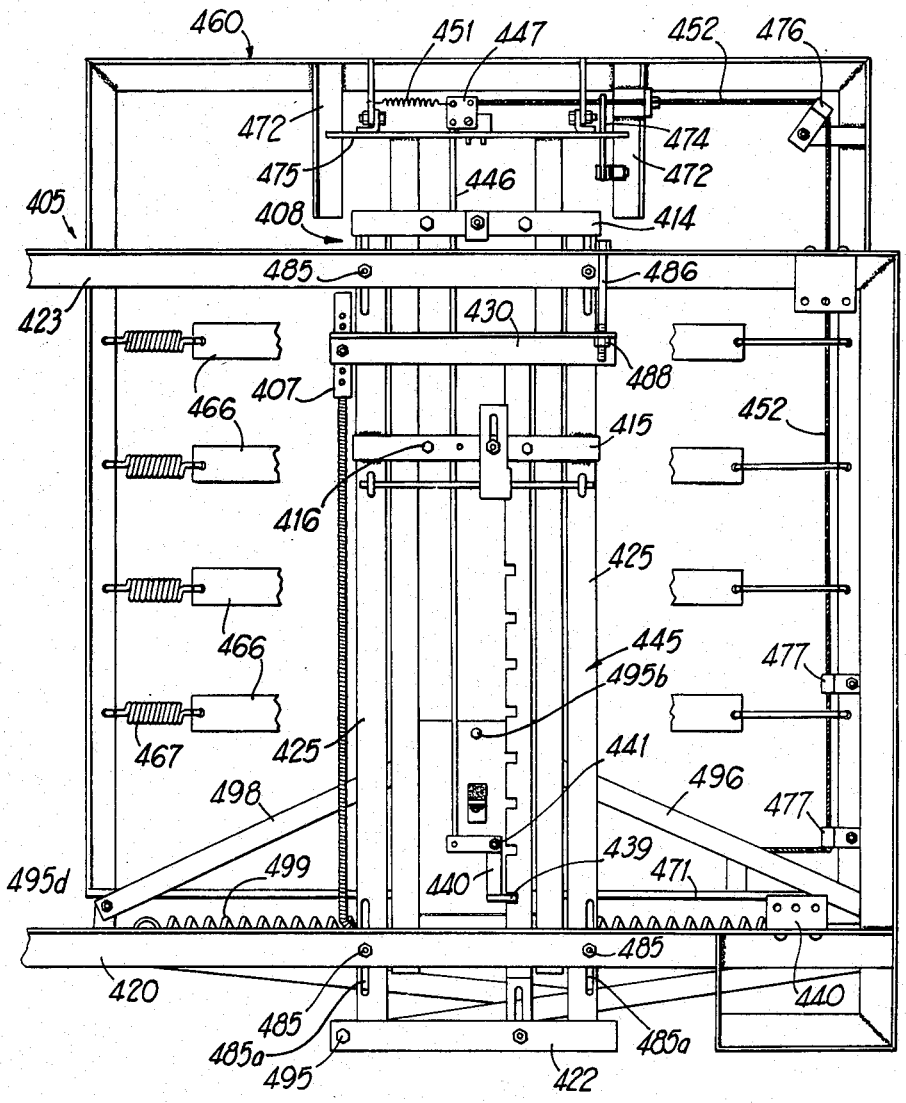
FIG. 17 is a rear elevational view of a fourth embodiment of the head board assembly in its lowered position.

A fourth embodiment initially illustrated in FIG. 15, is comprised of various elements disclosed in the previous three embodiments, including: back frame 418, side struts 421, cross struts 422 and 423, latch receiving members 431*a* with finger receiving slots 438, latch fingers 439, bellcranks 440, pivot pins 441, support standards 445, actuator rods 446, bellcranks 447, pivot pins 448, brackets 449, mounting plates 450, tension springs 451, control cables 452, backrest frames 460, handles 454, brackets 461 and 463, pivot pins 462, cross bars 464, arms 465, straps 466, springs 467, attachment means 468, hinged straps 469, fasteners 469*a* and 469*b*, cushions 470 (not shown), rods 471, arms 472, pivot pins 473, pivot fingers 474, arms 475, and brackets 476 and 477, arms 476*a*, pins 476*b*, and ferrels 476*e*. These elements function in the same manner as enumerated above in the detailed description of the previous embodiments. However, the fourth embodiment includes the following improvements: This embodiment utilizes a spring and scissors assembly to provide constant tension on the backrest assembly 405, comprised of an L-shaped first or base arm 494 which is pivotally attached at its straight end to cross strut 422 by pivot pin 495. Arm 494 is pivotally attached at its other or L-shaped end to one end of arm 496 by pin 495*a*. Arm 496 is pivotally attached at its other end to the upper midportion of support plate 401 of support standard 445 by pin 495*b*. Pivotally attached at its straight end to the inner midportion of first arm 494 by pin 495*c* is L-shaped arm 497. Pivotally attached to the other or L-shaped end of arm 497 by pin 495*d* is arm 498. Arm 498 is also pivotally attached at its other end to the upper midportion of support plate 401 with arm 496 by pin 495*b*. Attached to the outer, L-shaped end of arm 494 by hook 404 is adjusting piece 403. Spring 499 is attached at one end to adjusting piece 403 and at its other end to the outer, L-shaped end of arm 497 by hook 404*a*. Therefore, as is seen in FIG. 15, when support standard 445 is lowered, thereby pushing arms 496 and 498 outwardly which in turn causes the outer ends of arms 494 and 497 to move away from one another, spring 499 is extented or stretched within its elastic limits. In this position, spring 499 tends to contract, bringing arms 494 and 497 into a more vertical position. Arms 496 and 498 in turn push support standard 445 upward. The backrest frame 460 is attached to the upper portion of slidable standard 445 identically as discussed in the previous embodiments. The cushion 470 (not shown) is also attached to arms 465 as shown in FIG. 4 and as discussed above. The backrest assemblies 405 are substantially balanced in any vertical position thereof by adjusting the attachment of spring 499 with adjusting piece 403 so that when cushion 470 is attached to backrest frame 460, their weight is supported by the constant tension assembly at any height. This allows the backrest assembly 405 to be easily vertically adjusted with a minimal amount of manual urging. When backrest assembly 405 is in its lowest position as shown in FIG. 16, an auxiliary spring 499*a* is needed to assist in urging the backrest frame 460 upward from this lowermost resting position. Auxiliary spring 499*a* is attached at one end to the outer lowermost portion of arm 406 which projects from support plate 401 and at its other end to vertical adjusting piece 407 which is attached to standard support assembly 408. As is seen in FIG. 16, when backrest frame 460 is in its lowest position, spring 499*a* is extended or stretched within its elastic limits. Spring 499*a* thus tends to contract, and so aids in urging backrest frame 460 into a raised position. As seen in FIG. 15, the attachment of spring 499*a* to the outer lowermost portion of arm 406 ensures that spring 499*a* will not stack and so will bend outwardly, away from support plate 401 and standard support assembly 408 when spring 499*a* is contracted. Thus, spring 499*a* does not interfere with the slidable vertical movement of support standard 445. It is also important that spring 499*a* be of such a charachter so that it does not have initial tension. This ensures that spring 499*a* aids in raising backrest assembly 405 with manual urging from its lowest position, but does not in and of itself cause undue unbalancing of the substantial constant tension assembly.

Standard 445 differs in design from that of the previous embodiments in that it is comprised of support plate 401 which is attached to the lower portion of channel-shaped rails 402. For guiding support standard 445 in its vertical movement, channel-shaped rails 402 receive guide rollers 409 in their channels 410. Rollers 409 are mounted by pins 412 to support bracket 408. It is preferred to mount two guide rollers 409 in vertical relationship onto standard support assembly 408 on one side of standard 445 and only one guide roller 409 onto standard support assembly 408 on the other side of support standard 445 in order to prevent the possibility of support standard 445 binding. Low friction rollers 413 are mounted on arm brackets 414 and 415 of standard support assembly 408 by pins 416 and contact the interior flanges of rails 402 to provide for low friction vertical movement of support standard 445. Attached to arm bracket 414 by pin 418 is stop 417. Stop 417 contacts stop 419 which is mounted on the back of support plate 401 when standard 445 is in its uppermost vertical position. This prevents support standard 445 from being pushed out of standard support assembly 408. At the top of support standard 445 is pivotally mounted backrest assembly 460 onto mounting plate 450 in the same manner as described in the previous embodiments.

Side struts 421 include apertures 429 for adjustably mounting bed rails 428. This allows the height of the mattress (not shown) to be easily and readily adjusted. Headboard 424 can also be easily mounted onto cross strut 422 with mounting brackets 440 and also with bolts 480 and nuts 481 through apertures 482. As shown in FIG. 15, bracket 440 can be horizontally adjusted on cross strut 422 by changing the apertures 483 into which pins 484 are received.

Another feature of this embodiment is that standard support assembly 408 can be adjusted to incrementally adjust support standard 445 and thus frame 460 up or down in relation to back frame 423 and thus top of the mattress, by loosening mounting pins 485 which are anchored in cross struts 422 and 423 and turning adjusting bolt 486 which is journaled in aperture 487 of cross strut 423. Adjusting bolt 486 and nut 488 are threaded or unthreaded to adjust the height of standard support assembly 408 relative to back frame 418. When the desired height of standard support assembly 408 is achieved, mounting pins 485 are then tightened to anchor support bracket 408 against back frame 418.

As previously discussed, the remaining elements of the fourth embodiment, which are identical to those of previous embodiments, function and cooperate in the same manner as the elements in the previous embodiments.

What I claim is:

1. A bed assembly including a bed having a mattress extending in generally a horizontal position, the improvement comprises the headboard assembly, at one end of said bed comprising:

a. a back frame spaced from the end of said bed, base bars extending forwardly from the lower portion of said back frame toward said bed, and legs connected to said base bars and said bed, said back frame defining, with the end of said mattress, a transversely extending upwardly open backrest assembly receiving cavity;

b. a vertically moveable backrest assembly received by its lower portion in said cavity; and c. counterbalance means on said back frame for substantially counterbalancing said backrest assembly along its entire path of travel for vertical movement into and out of said cavity.

2. The bed assembly defined in claim 1, wherein said backrest assembly, includes an upright standard carried by said back frame and moveable vertically with respect thereto, detent means for locking said standard in prescribed positions along its path of movement, and a backrest frame pivotally mounted on the upper end portion of said standard, for pivoting outwardly over the mattress of said bed, when said standard is in a raised position.

3. The bed assembly defined in claim 2 including a cushion removeably mounted on the front surface of said backrest frame.

4. The bed assembly defined in claim 1, wherein said counterbalance means includes a spring connected by one end to said frame, a cable extending from the other end of said spring, a cam assembly having a cam provided with a varying radius surface around which said cable extends, and a second cable extending from said cam assembly to one of said backrest assembly, said cam assembly being rotatable for taking in one of the cables while progressively releasing portions of the other cable and vice versa.

5. The bed assembly defined in claim 4, wherein said varying radius surface is an involute.

6. The bed assembly defined in claim 1, wherein said counterbalance means includes a substantially constant tension counterbalance assembly for yieldably supporting said backrest assemblies on said back frame.

7. The bed assembly defined in claim 1, wherein said backrest assembly includes a U-shaped frame, straps extending across said U-shaped frame, a cushion mounted on the front surface of said U-shaped frame, and a standard moveably carried by said back frame, said U-shaped frame being pivotally connected to the upper end portion of said standard, so that when said standard is raised, said backrest assembly may be individually moved outwardly so as to extend over said mattress, and so that the end portion of said frame rests upon the surface of said mattress.

8. The bed assembly defined in claim 7, wherein said counterbalance means includes a cable connected to said standard, a cam assembly having a surface along which said cable is disposed, a second cable disposed along a second surface of said cam assembly so that the cables act in opposition to each other, and a spring connected to said second cable and also to said back frame.

9. The bed assembly defined in claim 1, wherein said counterbalance means includes a spring and scissors assembly comprising a plurality of arms pivoted at their ends and connected by a spring or tension means.

10. The bed assembly defined in claim 1, wherein said counterbalance means includes a spring and scissors assembly comprising: a first arm pivotally attached to said back frame at one end and pivotally attached to a second arm at the other end, said second arm being also pivotally attached to said backrest assembly, and a third arm pivotally attached to said frame at one end and also pivotally attached to a fourth arm at its other end, said fourth arm being also pivotally attached with said second arm to said backrest assembly, and a first spring attached at one end to said first arm and attached at its other end to said third arm, and a second spring attached at one end to said back frame and at its other end to either said second arm or said fourth arm.

11. A headboard assembly comprising: a main frame provided with an upright back frame and a base for holding said back frame upright, a standard disposed vertically adjacent to said back frame, said standard being moveable upwardly and downwardly in a fixed vertical path with respect to said back frame, a cable connected to said standard, a cam assembly pivotally mounted for rotation about an axis on said back frame, said cam assembly having a surface along which said cable extends, a second cable, said cam assembly having a second surface along which said second cable extends, a spring connected at one end to said second cable, the other end of said spring being connected to said back frame, and a backrest on the upper end portion of said standard, said cam assembly varying the distance that the respective cables are from said axis for applying a counterbalancing substantially constant tension to said standard.

12. The headboard assembly defined in claim 11, including a backrest frame pivotally carried by the upper end portion of said standard, a cushion mounted on said backrest frame, and a control cable extending around the inner portion of said backrest frame, detent means on said standard for engaging a portion of said back frame, said control cable being connected to said detent means for actuating said detent means to latch said standard in prescribed vertical positions with respect to said back frame.

13. The headboard assembly defined in claim 12 wherein said control cable is attached at one end to said backrest frame.

14. The headboard assembly defined in claim 12, including a finger engageable with a portion of said control cable for moving said cable out of its normal position for actuating said detent means when said control cable is moved out of its normal position, said finger being connected to said backrest frame so that when said backrest frame is vertically disposed, said finger deflects said control cable sufficiently to unlatch said detent means, and when said backrest frame is pivoted outwardly from its vertical position, said finger is removed from said control cable sufficiently to permit said detent means to latch.

15. The headboard assembly defined in claim 12, wherein said cam assembly includes a cam provided with an involute surface and over which said second cable extends, and a second cam having a camming surface of varying radius and over which said first cable extends.

16. The headboard assembly defined in claim 12, including a U-shaped frame having parallel arms and pivotally mounted on said standard, said U-shaped frame having a plurality of parallel straps extending between said arms, and a thin rod joining the ends of said frame.

17. A headboard assembly comprising: a main frame provided with an upright back frame and a base for holding said back frame upright, a standard disposed vertically adjacent to said back frame, said standard being moveable upwardly and downwardly in a fixed vertical path with respect to said back frame, a first arm pivotally attached to said back frame at one end and pivotally attached to a second arm at the other end, said second arm being also pivotally attached to said standard, and a third arm pivotally attached to said frame at one end and also pivotally attached to a fourth arm at its other end, said fourth arm being also pivotally attached with said second arm to said standard, and a first spring attached at one end to said first arm and attached at its other end to said third arm, and a second spring attached at one end to said back frame and at its other end to either said second or said fourth arm.

18. The headboard assembly defined in claim 17, including a backrest frame pivotally carried by the upper end portion of said standard, a cushion mounted on said backrest frame, and a control cable extending around the inner portion of said backrest frame, detent means on said standard for engaging a portion of said back frame, said control cable being connected to said detent means for actuating said detent means to latch said standard in prescribed vertical positions with respect to said back frame.

19. The headboard assembly defined in claim 17, including a finger engageable with a portion of said control cable for moving said cable out of its normal position for actuating said detent means when said control cable is moved out of its normal position, said finger being connected to said backrest frame so that when said backrest frame is vertically disposed, said finger deflects said control cable sufficiently to unlatch said detent means, and when said backrest frame is pivoted outwardly from its vertical position, said finger is removed from said control cable sufficiently to permit said detent means to latch.

20. The headboard assembly defined in claim 17, incluidng a U-shaped frame having parallel arms and pivotally mounted on said standard, said U-shaped frame having a plurality of parallel straps extending between said arms, and a thin rod joining the ends of said frame.

21. A bed assembly including a bed having a mattress extending in generally a horizontal position, the improvement comprises the headboard assembly, at one end of said bed comprising:

a. a back frame spaced from the end of said bed and including means to mount the side rails of said bed at selective vertical positions;

b. a vertically moveable backrest assembly received by its lower portion between the side rails of said bed;

c. counterbalance means on said back frame for substantially counterbalancing said backrest assembly along its entire path of travel for vertical movement.

22. The bed assembly defined in claim 21 wherein said counterbalance means includes a multiple lever arm and spring combination.

23. The bed assembly defined in claim 21, wherein said backrest assembly includes an upright standard carried by said back frame and moveable vertically with respect thereto, detent means for locking said standard in prescribed positions along its path of movement, and a backrest frame pivotally mounted on the upper end portion of said standard, for pivoting outwardly over the mattress of said bed, when said standard is in a raised position.

24. The bed assembly defined in claim 23 including a cushion removeably mounted on the front surface of said backrest frame.

25. The bed assembly defined in claim 24 wherein said backrest assembly and said cushion are received between said side rails of said bed so that only a portion of said cushion remains above said mattress of said bed when said backrest assembly is in its lowered position.

26. The bed assembly defined in claim 21, wherein said counterbalance to eliminate the non sequitur means includes a substantially constant tension counterbalance assembly for yieldably supporting said backrest assemblies on said back frame.

27. The bed assembly defined in claim 21, wherein said backrest assembly includes a U-shaped frame, straps extending across said U-shaped frame, a cushion mounted on the front surface of said U-shaped frame, and a standard moveably carried by said back frame, said U-shaped frame being pivotally connected to the upper end portion of said standard, so that when said standard is raised, said backrest assembly may be individually moved outwardly so as to extend over said mattress, and so that the end portion of said frame rests upon the surface of said mattress.

28. A headboard assembly for mounting at the head of a bed comprising: a back frame, a standard disposed vertically adjacent to said back frame, said standard being moveable upwardly and downwardly in a fixed vertical path with respect to said back frame, a first arm pivotally attached to said back frame at one end and pivotally attached to a second arm at the other end, said second arm being also pivotally attached to said standard, and a third arm pivotally attached to the lower midportion of said first arm at one end and also pivotally attached to a fourth arm at its other end, said fourth arm being also pivotally attached with said second arm to said standard, and a first spring attached at one end to said second arm and attached at its other end to said fourth arm, and a second spring attached at one end to said back frame and at its other end to said support standard.

29. The headboard assembly defined in claim 28, including a backrest frame pivotally carried by the upper end portion of said standard, a cushion releasably mounted on said backrest frame, means for releasably mounting said cushion onto said backrest frame, a control cable extending around the inner portion of said backrest frame, latch receiving means, detent means on said standard for engaging said latch receiving means, said control cable being connected to said detent means for actuating said detent means to latch said standard in prescribed vertical positions with respect to said back frame.

30. The headboard assembly defined in claim 29 wherein said means for releasably mounting said cushion includes rigid members attached to said cushion, hinged straps mounted onto the ends of said rigid members and means for releasably engaging said backrest frame attached to said hinged straps for releasable attachment of said cushion to said backrest frame.

31. The headboard assembly defined in claim 29 wherein said control cable is attached at one end to said backrest frame.

32. The headboard assembly defined in claim 29, including a finger engageable with a portion of said control cable for moving said cable out of its normal position for actuating said detent means when said control cable is moved out of its normal position, said finger being connected to said backrest frame so that when said backrest frame is vertically disposed, said finger deflects said control cable sufficiently to unlatch said detent means, and when said backrest frame is pivoted outwardly from its vertical position, said finger is removed from said control cable sufficiently to permit said detent means to latch.

33. The headboard assembly defined in claim 29, wherein said backrest frame includes a U-shaped frame having parallel arms and pivotally mounted on said standard said U-shaped frame having a plurality of parallel straps extending between said arms, and a thin rod joining the ends of said frame.

34. The headboard assembly defined in claim 28, wherein at least one of said arms being substantially L-shaped thereby creating a cavity between said arms to receive said first spring when said slidable standard is in a lowered position.

35. The headboard assembly defined in claim 28 and means for selectively adjusting the tension in said first spring.

36. The headboard assembly defined in claim 28 and means for selectively adjusting the tension in said second spring.

37. The headboard assembly defined in claim 28, wherein said second spring does not contain initial tension.

38. The headboard assembly defined in claim 28, wherein said standard is provided with means for flexing said second spring outwardly when said headboard assembly is in a raised position and said second spring is contracted.

39. The headboard assembly defined in claim 28 and means for selectively adjusting the height of said headboard assembly.

40. The headboard assembly defined in claim 28, including stops mounted to restrict vertical movement of said standard.

41. The headboard assembly defined in claim 40, wherein removal of said stops and said arms permits said headboard assembly to be readily disassembled.

42. The headboard assembly defined in claim 28, wherein said first arm pivots outside the path of movement of said second, third, and fourth arms.

43. The headboard assembly defined in claim 28, wherein said second and fourth arms are pivotally attached to said standard along the central vertical axis of said standard.

44. The headboard assembly defined in claim 28, wherein said standard is slidably received by low friction rollers to permit vertical movement thereof.

45. The headboard assembly defined in claim 29, wherein said cushion is releaseably attached to said headrest frame.

46. The headboard assembly defined in claim 28, wherein the height of said standard can be incrementally adjusted.

47. The headboard assembly defined in claim 29, wherein said backrest frame can be incrementally adjusted from a position substantially parallel to the horizontal surface of said mattress of said bed to a position perpendicular to said mattress of said bed.

48. A headboard assembly for mounting at the head of a bed comprising: a back frame, a support standard disposed vertically adjacent to said back frame, said support standard being movable upwardly and downwardly in a fixed vertical path with respect to said back frame, a backrest frame pivotally carried by the upper end portion of said support standard, and counterbalance means for substantially counterbalancing the total weight of said support standard and said backrest assembly along their entire paths of travel.

49. The headboard assembly defined in claim 29 wherein a single support standard supports each said backrest assembly.

50. The headboard assembly defined in claim 28 wherein grooved rollers guide said support standard.

* * * * *